United States Patent [19]

Rosen

[11] Patent Number: 4,594,730

[45] Date of Patent: Jun. 10, 1986

[54] APPARATUS AND METHOD FOR ENHANCING THE PERCEIVED SOUND IMAGE OF A SOUND SIGNAL BY SOURCE LOCALIZATION

[76] Inventor: Terry K. Rosen, 1314 S. Roxbury Dr., No. 2, Los Angeles, Calif. 90035

[21] Appl. No.: 601,661

[22] Filed: Apr. 18, 1984

[51] Int. Cl.[4] ..... H04R 5/00

[52] U.S. Cl. ..... 381/27; 381/18

[58] Field of Search ..... 381/27, 18, 19, 1, 17

[56] References Cited

U.S. PATENT DOCUMENTS

| | | | |
|---|---|---|---|
| 4,024,344 | 5/1977 | Dolby et al. | 381/27 |
| 4,121,059 | 10/1978 | Nakabayashi | 381/1 |
| 4,139,728 | 2/1979 | Haramoto | 381/1 |
| 4,309,570 | 1/1982 | Carver | 381/1 |
| 4,408,095 | 10/1983 | Ariga et al. | 381/27 |

*Primary Examiner*—Forester W. Isen

[57] ABSTRACT

This invention relates to an apparatus and to a method for enhancing the perceived sound image of a stereophonic, audio reproduction system whose inputs are a right and a left signal channel by decoding the right and left signal channels into a modified right, a modified left and a center signal channels. Signal information common to the original right and left signal channels is removed within a specified bandwith to produce the modified right and modified left signal channels. The original right and left signal channels are combined and frequencies below a predetermined cutoff frequency are attenuated to produce the center signal channel.

15 Claims, 2 Drawing Figures

APPARATUS AND METHOD FOR ENHANCING THE PERCEIVED SOUND IMAGE OF A SOUND SIGNAL BY SOURCE LOCALIZATION

BRIEF SUMMARY OF THE INVENTION

Throughout the history of sound recording and reproduction, there have always been attempts to improve the realism of the perceived sound image and convince the listener that he is indeed listening to a "live" performance. Even in the early days of acoustic recording, various techniques were tried. Experimentation accelerated with the advent of electrical recording and reproducing techniques in the 1920's.

Most of the approaches taken to date have been contrary to the reproduction of recorded sound from the standpoint of duplicating the psycho-acoustic phenomena that an individual experiences in nature. Certainly the prior art has done well with regard to improving the frequency response, signal-to-noise ratio, dynamic range, etc., of recorded sound. In short, the existing art teaches how to record and duplicate the sounds themselves, but it has failed to reproduce the recorded sounds in the manner by which we originally heard them.

When an individual hears sounds occurring in nature, he perceives two and only two types of acoustic information. These two types are those sounds perceived directly from the source, and those perceived which are reflected off other objects in the listening environment. While this reflected sound may be a multi-path signal coming to the listener from any and all directions, the direct sound comes to him from only one, that of the originating source.

In effect, then, sounds which reach a listener's ears directly from the source of the sound are "singular" or "monaural" in character; that is, there is only one wave propagating from the source to the listener. The ambient or secondary reflected sounds are "multiple" or "stereo" in nature, since they may arrive at the listener from different locations by different paths simultaneously.

Therefore, to accurately reproduce recorded sounds in the same manner by which a listener hears live sound, it is necessary to localize into one source the direct sounds while simultaneously preserving the ambient or reflected sounds in their true, multi-directional nature.

In general, prior art commerical stereo systems for home or mobile use rely on what is labeled a "phantom center channel" to reproduce the direct sound sources which are so important to the nature of human hearing.

With a phantom center channel, all monaural sounds which would normally appear to be localilzed in front of the listener are reproduced simultaneously with equal amplitude from both right and left channel speakers in an attempt to trick the ear-brain perception mechanisms into believing that the sound source is indeed located at a point directly in front of the listener. This system fails to reproduce an entirely successful illusion. (One reason for this failure is that in nature the simultaneous emission of two identical sounds from two different sources and locations does not occur.)

Ironically, most attempts at improving the illusion of live listening center around adding more sound reproducers (sources) and ambience information to the above-described flawed basic concept while still failing to address the important aspect mentioned above. No matter how many speakers surround the listener, nor how much delay, echo or other processing of the two-channel, right and left stereo signals is used, the psychoacoustic, ear-brain mechanism still searches for the proper element, a real, singular source of the direct sound information.

With the above background of the problem stated, it is now seen that an object of the present invention is to provide both a method and an apparatus for satisfying the psychoacoustic, ear-brain mechanism's perception of sound. This is accomplishedby enchancing the properties of a stereophonic audio reproduction system (whose input is derived from a two-channel stereophonic source) by improving the listener's perceptual localization of a newly derived center channel.

More specifically, it is desired to reproduce monaural source information exclusively through a single center reproducer while simultaneously removing all monaural source information from the two remaining standard stereo channels. This would leave only true stereo or ambient sound in the resulting two stereo channels and only monaural sound (or sound information previously common to both stereo channels) appearing in the new center channel.

In practice, this ideal separation of pre-recorded stereophonic sound information into three distinct signal channels cannot be achieved. Fortunately, however, it has been found that the degree of localization of a sound source need only approximate the ideal case in order to satisfy the psychoacoustic ear-brain mechanism.

The general principle involved remains the same, that is, the cancellation of monaural information appearing in both the left and right stereo channels by the subtraction of each signal channel from the other, such as left channel minus right channel and right channel minus left channel signals.

While subtracting one stereo channel from the other stereo channel does eliminate sound information common to both stereo channels, this subtraction of signals also destroys all separation, leaving in effect monaural difference information. This is not desirable.

Due to the nature of hearing and acoustics, as well as the nature of modern recording techniques, however, it is only necessary and indeed desirable to achieve the localization of a sound source over a limited frequency bandwidth for it to be effective. The bandwidth chosen is preferably about 400 Hertz to approximately 6,000 Hertz. This limited bandwidth offers several advantages as shall be seen in the description of the preferred embodiments of the apparatus of the invention given below.

A preferred embodiment of an apparatus built in accordance with the invention disclosed herein for enchancing the perceived sound image of a stereophonic, audio reproduction system having a right and a left signal channel by decoding the right and left signal channels into a modified right, a modified left and a center signal channels, comprises: first and second input terminals to which the right and left signal channels are respectively applied; a modified right, a modified left and a center output terminals, first band pass means connected to the first input terminal for attenuating signal frequencies outside of a first selected predetermined bandwidth; first phase correction means connected to the first band pass means for shifting the phase of the signal output from the first band pass means to maintain phase integrity with the left signal channel; first control means connected to the first phase correction means for selectively controlling the amplitude of the signal output from the first phase correction means; first inverter means connected to the first control means for inverting the signal output from the first control means; first mixer means connected to the first inverter means and to the second input terminal and to the modified left output terminal for applying a composite modified left signal channel formed by combining the signal output from the first inverter means and the left signal channel to the modified left output terminal; second band pass means connected to the second input terminal for attenuating signal frequencies outside of a said first selected predetermined bandwidth; second phase correction means connected to the second band pass means for shifting the phase of the signal output from the second band pass means to maintain phase integrity with the right signal channel; second control means connected to the second phase correction means for selectively controlling the amplitude of the signal output from the second phase correction means; second inverter means connected to the second control means for inverting the signal output from the second control means; second mixer means connected to the second inverter means and to the first input terminal and to the modified right output terminal for applying a composite modified right signal channel formed by combining the signal output from the second inverter means and the right signal channel to the modified right output terminals; center mixer means connected to the first and to the second input terminals for combining the right and left signal channels, respectively; and high pass filter means connected to the center mixer means and to the center output terminal for attenuating the signal output of the center mixer means below a selected predetermined center cutoff frequency and applying the output signal to the center output terminal.

Still two other alternate embodiments of an apparatus constructed in accordance with the invention disclosed herein which add a second modified right and a second modified left signal output terminals and additional means to enhance the ambience signals produced from the apparatus are described below in the description of the best embodiments contemplated.

A preferred embodiment of a method of enhancing the perceived sound image of a stereophonic audio reproduction system in accordance with the invention disclosed herein having a right and a left signal channels by decoding the right and left signal channels into a modified right, a modified left and a center signal channels, comprises: producing the modified left channel by attenuating those frequencies in the right signal channel that are outside of a first selected predetermined bandwidth to produce a limited bandwidth right signal channel; correcting the phase angle of the limited bandwidth right signal channel; controlling the amplitude of the limited bandwidth right signal channel; inverting the limited bandwidth right signal channel; combining the inverted, amplitude controlled, phase angle corrected, limited bandwidth right signal channel with the left signal channel to produce the modified left signal channel; outputting the modified left signal channel; and, producing the modified right signal channel by attenuating those frequencies in the left signal channel that are outside of the first selected predetermined bandwidth to produce a limited bandwidth left signal channel; correcting the phase angle of the limited bandwidth left signal channel; controlling the amplitude of the limited bandwidth left signal channel; inverting the limited bandwidth left signal channel; combining the inverted, amplitude controlled, phase angle corrected, limited bandwidth left signal channel with the right signal channel to produce the modified right signal channel; outputting the modified right signal channel; and, producing the center channel by combining the right and the left signal channels to form a combined signal; attenuating those frequencies in the combined signal channel that are below a center high pass cutoff frequency to produce the center signal channel; outputting the center signal channel.

It is another object of this invention to provide a device which is readily adaptable to existing stereophonic systems and will accept as its input the two-channel stereo output signals of such systems and deliver those modified signal channels that more closely imitate and reproduce the sound image perception of a listener at the source of the sound.

These and other objects of the invention will become more apparent from the following commentary taken in conjunction with the following figures of drawings.

DESCRIPTION OF THE BEST EMBODIMENTS CONTEMPLATED

Figure 1:
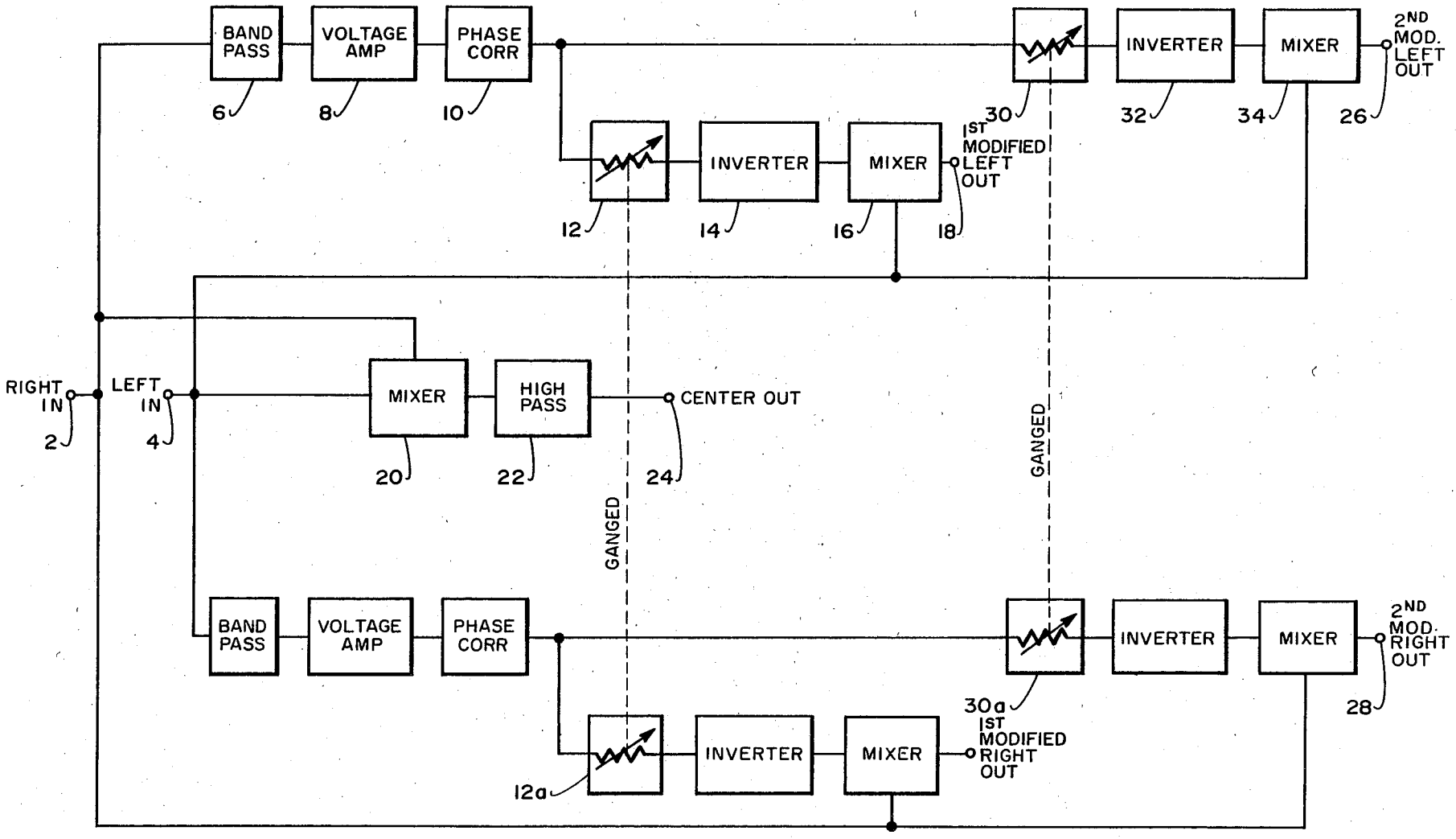
FIG. 1 is a schematic block diagram of an apparatus for enhancing the perceived sound image of a sound signal according to the present invention.

Referring to the figures of drawings wherein like numbers of reference designate like elements throughout, a preferred embodiment of an apparatus is shown in FIG. 1. The device, constructed in accordance with the invention disclosed herein, for enhancing the perceived sound image of a stereophonic, audio reproduction system whose input is derived from a two channel stereophonic source, has first and second input terminals, 2 and 4, to which the right and left signal channels are applied, respectively.

A band pass filter 6 is connected to input terminal 2 and attenuates right signal channel frequencies outside of a selected predetermined bandwidth. Due to the nature of hearing and acoustics, as well as the nature of modern recording techniques, empirical analysis has shown that the band pass filter 6 need only attenuate frequencies below about 400 Hertz and above approximately 6,000 Hertz for the localization of the sound source technique to be effective. This bandwidth of about 400 Hertz to about 6,000 Hertz is the preferred selected predetermined bandwidth.

Band pass filter 6 may be of any order, but in the preferred embodiment, a fourth-order band pass filter, such as a Butterworth-type filter is desired. In the alternative, cascaded, high and low pass filters may also be used.

A voltage amplifier 8 is connected to the output of the band pass filter 6 and amplifies the bandwidth limited right signal channel output of band pass filter 6 to ensure a sufficiently strong, modified signal to effectively cancel with the left signal channel when the signal channels are combined in the manner described below.

A phase angle correction means 10 is connected to the output of the voltage amplifier 8 to maintain phase integrity of the bandwidth limited right signal channel output of the voltage amplifier 8 with respect to the left signal channel. One preferred method is to shift the phase of the bandwidth limited right signal channel using all pass filter circuits by an amount calculated to negate the phase angle shift introduced into the bandwidth limited right signal channel by the band pass filter circuitry 6. As a non-limiting example, if the band pass filter circuitry 6 were of the fourth-order type, it would introduce a frequency dependent phase shift which would approach 180 degrees at the 3 db points into the bandwidth limited right signal channel with respect to the unaltered left signal channel. To maintain phase integrity with the unaltered signal channel, a fourth-order all-pass filter circuit (which may consist of cascaded all-pass filter circuits of lesser order inducing the same cumulative phase shift) is used in the apparatus.

A control circuit 12 is connected to the output of the phase correction means circuitry 10 to selectively control the amplitude of the now-phase corrected bandwidth limited right signal channel. For simplicity of construction and economy of cost, a preferred control circuit or device would be a variable potentiometer. Similarly, other amplitude control devices may be used, such as, but not limited to, an opto-electronic or other voltage control means.

As the circuitry used to produce the modified right signal channel is similar to that being described here for producing the modified left signal channel, it will be seen that the control circuit 12 may be mechanically or electrically ganged to a control circuit **12*a* used in producing the modified right signal channel. While it is not necessary to gang control circuits 12 and 12*a***, it is preferable for ease of operation to do so.

An inverter circuit 14 is connected to the output of the control circuit 12. Inverter circuitry 14 inverts the bandwidth limited right signal channel output from the control circuit 12 as a prelude to summing the bandwidth limited right signal channel and the unaltered left signal channel.

Mixer circuitry 16 is connected to the output of the inverter circuitry 14. Mixer circuitry 16 combines the now-amplitude controlled, inverted, phase corrected bandwidth limited right signal channel with the left signal channel and then outputs the resultant to a modified left output terminal 18.

To summarize, the modified left signal channel output terminal presents a signal channel having left signal channel information minus most of the common information in the most important 400 Hertz to 6,000 Hertz region. Additionally, since most natural and artificial ambience falls in this bandwidth, this information is now emphasized since it is not reduced in amplitude like the common information. This becomes the modified left signal channel.

An approach similar to that described above and illustrated in FIG. 1, is taken to derive a modified right signal channel. More specifically, the approach is mirror-image to that described above in deriving the modified left signal channel, i.e., in the above discussion interchange the terms left and right so that in the above discussion one would substitute the left signal channel input, applied to input terminal 4, for the right signal channel input applied to input terminal 2, and vice versa.

The center, or direct sound channel, is produced by having mixer circuitry 20 connected to the input terminals 2 and 4 to combine the right and left signal channels to produce a composite monaural signal channel.

A first order, high pass filter circuit 22 is connected to the output of mixer circuitry 20 and outputs to center output terminal 24, those composite monaural signal channel frequencies above a lower cutoff frequency. This high pass filter prevents redundant low frequency information in the center channel.

In the preferred embodiment described above, no phase correction means is shown in the center channel following the high pass filter circuit 22 for several reasons. First, unlike the left and right channel signals, the center channel output signal is not used in a signal cancellation mode and therefore exact phase tracking is not required. Second, the preferred high pass filter circuitry utilized in the center channel is a first order type that produces a 45-degree phase shift in the center signal at the 3 db point. This small amount of phase shift causes little to no confusion to the ear-brain hearing mechanism.

It should be noted at this point, that the use of a variable potentiometer, or the like circuitry, as a control means to selectively control the amplitude of the phase corrected bandwidth limited right signal channel, presents the listener with many listening and localizing of sound sources possibilities which fall into three distinct categories. First, when the amplitude of the modified signal channel is less than that of the unmodified signal channel, a moderate amount of localization of a sound source takes place while enhancing channel separation (stereo effect). Second, when the amplitude of the modified signal channel is equal to that of the unmodified signal channel, all information common to the two signal channels in the pass band is cancelled, presenting the listener with the strongest aural sense of localization of a sound source. In the third case, the amplitude of the modified signal channel is greater than that of the unmodified signal channel. The resulting combined signal emphasizes whatever ambience exists in the program material in the pass band frequencies. This last situation occurs because the reflected or multi-path sounds which normally carry the ambience to the listener are random-phase in nature and are usually concentrated in the pass band (400 Hertz through 6,000 Hertz) frequencies. This is due to the fact that high frequencies are generally absorbed by the surroundings, while low frequencies are generally omni-directional in nature. Therefore, by increasing the amplitude of the mid-range frequencies found in the modified signal channel (while continuing to cancel the common information), this ambient information is emphasized. This results in an enhanced perception of depth and spaciousness. It should also be noted at this point that most inaccuracies and distortions which occur in tape and disk recording and playback as well as in radio transmissions are located at the audio bandwidth extremes. That is, they exist mostly at the very low and very high frequencies. The very nature of these distortions is such that they generate substantial amounts of phase shift, noise and harmonic distortion. By careful selection of the band pass frequencies prior to the left minus right and right minus left channel summation, exaggeration of these distortions at the frequency extremes is avoided.

While only three output terminals for the modified right, the modified left and the center signal channels are the minimum necessary to create the source localization for a listener, FIG. 1 shows second modified left and modified right signal channel outputs 26 and 28, respectively.

Circuitry similar to that already described above in producing the first modified left signal channel at the first modified left signal channel output terminal 18 is used to produce the second modified left signal channel at output terminal 26.

More specifically, control circuitry 30 is connected to the output of the phase correction means circuitry 10 to selectively control the amplitude of the now-phase corrected bandwidth limited right signal channel. A preferred control circuit or device would be a variable potentiometer. (Similarly, other amplitude control devices may be used, such as, but not limited to, an optoelectronic or other voltage control means.) As the circuitry used to produce the second modified right signal channel is similar to that being described here for producing the second modified left signal channel, it will be seen that the control circuit 30 may be mechanically or electrically ganged to a control circuit 30*a* used in producing the second modified right signal channel. While it is not necessary to gang control circuits 30 and 30*a*, it is preferable for ease of operation to do so. However, to permit a listener to independently adjust mixing levels for the first and second modified right and left channels to allow the optimum amount of localization of a sound source at these first and second output terminal locations, control means 12 and 30 (and their associated control circuitry 12*a* and 30*a*, respectively) should not be ganged together.

An inverter circuit 32 is connected to the output of the control circuit 30. Inverter circuitry 32 inverts the bandwidth limited right signal channel output from the control circuit 30 as a prelude to summing the bandwidth limited right signal channel and the left signal channel.

Mixer circuitry 34 is connected to the output of inverter circuitry 32 and input terminal 4. Mixer circuitry 34 mixes the output of inverter circuitry 32 with the left signal channel and outputs the resultant to a second modified left output terminal 26.

A similar approach is taken to derive a second modified right signal channel.

Figure 2:
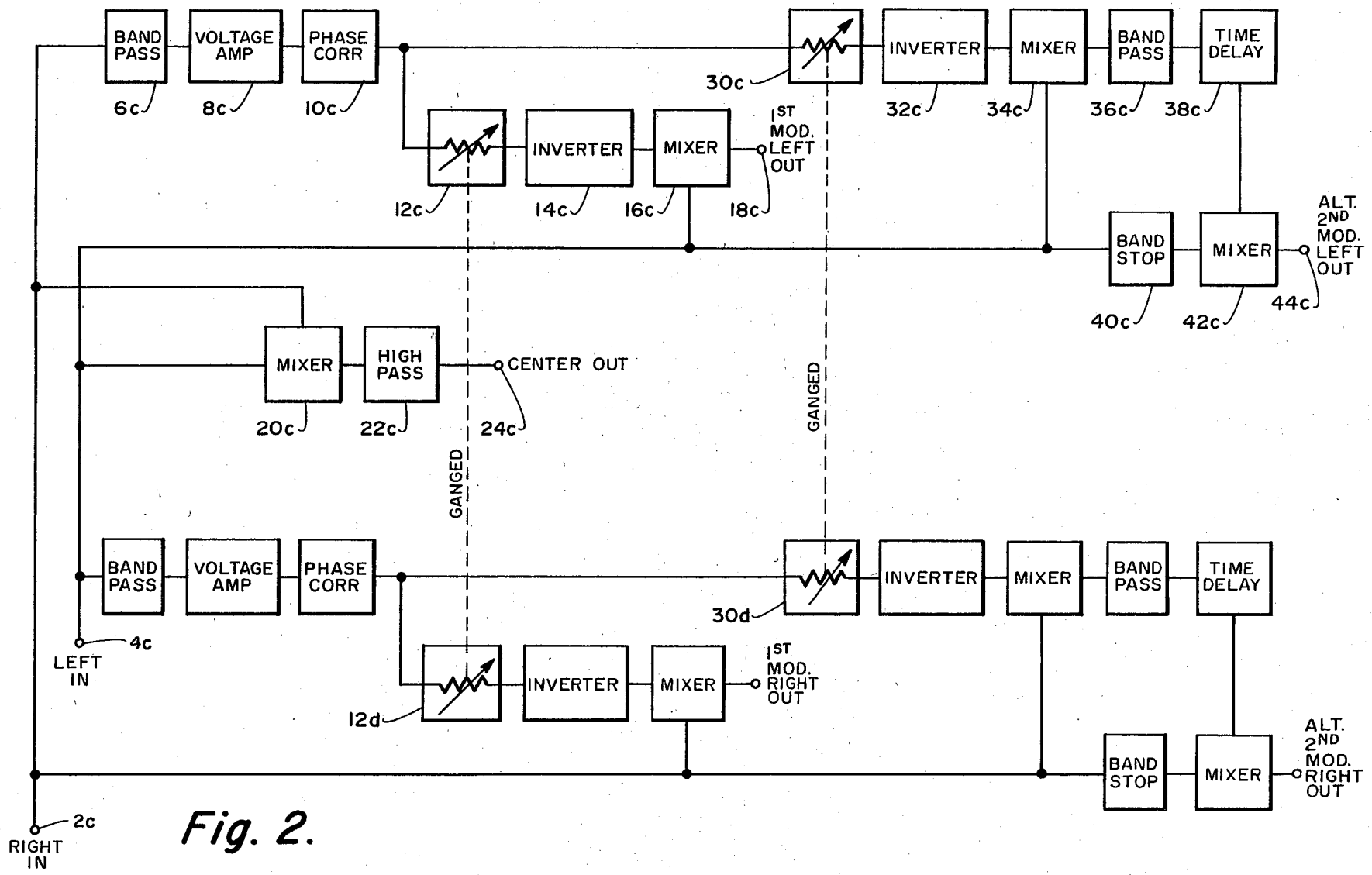
FIG. 2 is a schematic block diagram of an alternate apparatus for enhancing the perceived sound image of a sound signal according to the present invention.

In FIG. 2 is shown a second alternate preferred embodiment of an apparatus made in accordance with the invention disclosed herein for enhancing the perceived sound image of a stereophonic audio reproduction system having a right and a left signal channels by decoding said channels into an alternate second modified right and an alternate second modified left signal outputs.

In FIG. 2, schematic blocks 2*c* through 34*c*, 12*d* and 30*d* are similar to schematic blocks 2 through 34, 12*a* and 30*a*, respectively, in FIG. 1 described above.

Band pass circuitry 36*c* is connected to the output of mixer circuitry 34*c* and attenuates the signal output of mixer 34*c* outside of a selected predetermined bandwidth.

A means to time delay the bandwidth limited signal output from the band pass circuitry 36*c* is connected to band pass circuitry 36*c* and is shown in FIG. 2 as schematic block 38*c*. The time delay circuitry employed may either delay the signal by a fixed or variable amount to suit the listener as well as the specific environment and program material with which the system is used.

Band stop circuitry 40*c* is connected to the left signal channel input terminal 4*c* and mixer circuitry 42*c*, to attenuate those frequencies falling within a selected predetermined bandwidth.

Mixer circuitry 42*c* is connected to the output of the time delay circuitry 38*c*. Mixer circuitry 42*c* mixes the output signal from time delay circuitry 38*c* with the output of the band stop circuitry 40*c* and delivers the resultant signal to an alternate second modified left output terminal 44*c*.

A similar but mirror-imaged approach is taken to derive an alternate second modified right signal channel.

The advantage of this second alternate embodiment of an apparatus constructed in accordance with the invention disclosed herein is that it permits the listener to control the apparent size of his listening environment by increasing the time delay of the pass band frequencies in the second modified left and right signal channels. This emulates the natural occurrence of generally longer path lengths (and hence longer delay times) of sounds reflected back to the listener from the rear of auditoriums, theaters, and other natural listening environments.

This manner of applying time delay only to the passband frequencies and then re-mixing in the frequency extremes offers several advantages over conventional approaches: First, low frequency information produced from these delayed channels will occur in the same time frame as that of the other modified channels. This eliminates phase and frequency response irregularities at low frequencies in the listening environment. Second, time delay is effectively used to augment the natural ambience which is already present in the passband frequencies. Third, time delay circuitry is confined to an area of optimum performance and avoids signal degradation which can occur when operating such delay circuitry over wide bandwidths.

A method in accordance with the invention disclosed hereinfor enhancing the perceived sound image of a stereophonic audio reproduction system having a right and a left signal channel by decoding the right and left signal channels into a modified right, a modified left and a center signal channels, comprises, producing the modified left signal channel by attenuating those frequencies in the right signal channel that are outside of a selected predetermined bandwidth to produce a limited bandwidth right signal channel; correcting the phase angle of the limited bandwidth right signal channel; controlling the amplitude of the limited bandwidth right signal channel; inverting the limited bandwidth right signal channel; and mixing the resulting right signal channel with the left signal channel to produce the modified left signal channel; and outputting the modified left signal channel.

Similarly, the method produces the modified right signal channel by attenuating those frequencies in the left signal channel that are outside of a selected predetermined bandwidth to produce a limited bandwidth left signal channel; correcting the phase angle of the limited bandwidth left signal channel; controlling the amplitude of the limited bandwidth left signal channel; inverting the limited bandwidth left signal channel; and mixing the resulting left signal channel with the right signal channel to produce the modified right signal channel; and outputting the modified right signal channel.

The preferred method produces the center signal channel by electronically mixing the right and left signal channels to form a combined signal; attenuating those frequencies in the combined signal channel that are below a center high pass cutoff freqeuncy to produce the center signal channel; and outputting the center signal channel.

While electronic mixing is the preferred method for producing the center signal channel, it should be noted that center channel mixing may be accomplished acoustically. Acoustical center channel mixing is achieved when each individual channel of the two channel stereophonic source is fed to its own individual reproducer (therefore requiring at least two such reproducers) and, when these reproducers are separated by a distance that is small when compared to the distance from the reproducers to a preferred listening location.

With either method of center channel mixing, low frequency attenuation is still desired.

A device has been constructed in accordance with the invention disclosed herein for empirical analysis, and is described below as a non-limiting example of an existing device embodying the invention taught herein.

The existing test device was constructed to adapt to an existing automobile stereophonic radio/tape player system. It accepts the two stereo channel output of the commercial radio/tape player system as its input and in turn delivers a three separate channel output as described above.

The existing device has been noted by the observations of a large number of test subjects (some aware and others unaware of the existence and/or purpose of the device) to substantially enhance the sound image perceived as to the localization of originating sound sources.

Test subjects have reported a more natural and lifelike sound from the test device than from the unaltered automobile stereophonic radio/tape player system.

A second test device was constructed similar to the first device, but using discrete components instead of integrated circuits in its circuitry. To date, test subjects have expressed a preference for the discrete component version of the device over the version utilizing integrated circuitry.

The invention described above is, of course, susceptible to many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the example of the invention herein disclosed for the purpose of illustration which do not consititute departures from the spirit and scope of the invention.

I claim:

1. An apparatus for enhancing the perceived sound image of a stereophonic, audio reproduction system whose inputs are a right and a left signal channels, and whose outputs are a modified right, a modified left and a centersignal channels, comprising: first and second input terminals to which the right and left signal channels are respectively applied; a first modified right, a first modified left and center output terminals; first band pass means connected to said first input terminal for attenuating signal frequencies ouside of a selected predetermined bandwidth; first phase correction means connected to the first band pass means for shifting the phase of the signal output from the first band pass means to maintain phase integrity with the left signal channel; first voltage control means connected to the first phase correction means for selectively controlling the amplitude of the signal output from the first phase correction means; first inverter means connected to the first control means for inverting the signal output from the first control means; first mixer means connected to the first inverter means and to the second input terminal and to the first modified left output terminal for applying a composite modified left signal channel formed by combining the signal output from the first inverter means and the left signal channel and applying the output signal to the first modified left output terminal; second band pass means connected to the second input terminal for attenuating signal frequencies outside of said selected predetermined bandwidth; second phase correction means connected to the second band pass means for shifting the phase of the signal output from the second band pass means to maintain phase integrity with the right signal channel; second control means connected to the second phase correction means for selectively controlling the amplitude of the signal output from the second phase correction means; second inverter means connected to the second control means for inverting the signal output from the second control means; second mixer means connected to the second inverter means and to the first input terminal and to the first modified right output terminal for applying a composite modified right signal channel formed by combining the signal output from the second inverter means and the right signal channel to the first modified right output terminal; center mixer means connected to the first and to the second input terminals for combining the right and left signal channels, respectively; high pass filter means connected to the center mixer means and to the center output terminal for attenuating the signal output of the center mixer means below a selected predetermined center cutoff frequency and applying the output signal to the center output terminal.

2. The apparatus in accordance with claim 1 further including: first amplification means connected to the first band pass means and to the first phase correction means for amplifying the voltage of the output signal from the first band pass means and applying the amplified signal to the first phase correction means.

3. The apparatus in accordance with claim 2 further including: second amplification means connected to the second band pass means and to the second phase correction means for amplifying the output signal from the second band pass means and applying the amplified signal to the second phase correction means.

4. The apparatus in accordance with claim 3 wherein the first and second phase correction means are all pass filters.

5. The apparatus in accordance with claim 4 wherein the first and second control means are variable potentiometers.

6. The apparatus in accordance with claim 3 wherein the first and second control means are ganged variable potentiometers.

7. The apparatus in accordance with claim 6 wherein said selected predetermined bandwidth has a lower cutoff frequency of approximately 400 Hertz.

8. The apparatus in accordance with claim 7 wherein said selected predetermined bandwidth has an upper cutoff frequency of approximately 6,000 Hertz.

9. The apparatus in accordance with claim 1 further including: a second modified left and a second modified right output terminals; third control means connected to the first phase correction means for selectively controlling the amplitude of the signal output from the first phase correction means; third inverter means connected to the third control means for inverting the signal output from the third control means; third mixer means connected to the third inverter means and to the second input terminal and to the second modified left output terminal for applying a composite second modified left signal channel formed by combining the signal output from the third inverter means and the left signal channel to the second modified left output terminal; fourth control means connected to the second phase correction means for selectively controlling the amplitude of the signal output from the second phase correction means; fourth inverter means connected to the fourth control means for inverting the signal output from the fourth control means; fourth mixer means connected to the fourth inverter means, and to the first input terminal and to the second modified right output terminal for applying a composite second modified right signal channel formed by combining the signal output from the fourth inverter means and the right signal channel to the second modified right output terminal.

10. The apparatus in accordance with claim 9 wherein the third and fourth control means are ganged, variable potentiometers adapted to be independently selectively controlled from said frist and second control means.

11. The apparatus in accordance with claim 10 further including: alternate second modified left and alternate second modified right output terminals; third band pass means connected to the third mixer means for attenuating signal frequencies outside of a second selected predetermined bandwidth; first time delay means connected to the third band pass means to selectively delay the signal output of the third band pass means; first band stop means connected to the second input terminal to selectively attenuate signal frequencies within said second selected predetermined bandwidth; fifth mixer means connected to the first time delay means and to the first band stop means and to the alternate second modified left output terminal for applying a composite alternate second modified left time-delayed signal channel formed by combining the time-delayed signal output from the first time delay means and the signal output from the first band stop means to the alternate second modified left output terminal; fourth band pass means connected to the fourth mixer means for attenuating signal frequencies outside of said second selected predetermined bandwidth; second time delay means connected to the fourth band pass means to selectively delay the signal output of the fourth band pass means; second band stop means connected to the first input terminal to selectively attenuate signal frequencies within said second selected predetermined bandwidth; sixth mixer means connected to the second time delay means and to the second band stop means and to the alternate second modified right output terminal for applying a composite alternate second modified right time-delayed signal channel formed by combining the time delayed signal output from the second time delay means and the signal output from the second band stop means to the alternate second modified right output terminal.

12. A method for enhancing the perceived sound image of a stereophonic audio reproduction system whose inputs are derived from a two channel stereophonic source by processing said inputs into a modified right, a modified left, and a center signal channels, comprising: producing the modified left signal channel by attenuating those frequencies in the right signal channel that are outside of a selected predetermined bandwidth to produce a limited bandwidth right signal channel; correcting the phase angle of the limited bandwidth right signal channel; controlling the amplitude of the limited bandwidth right signal channel; inverting the limited bandwidth right signal channel; mixing the limited bandwidth, phase angle corrected, amplitude controlled, inverted right signal channel with the left signal channel to produce the modified left signal channel; outputting the modified left signal channel; producing the modified right signal channel by attenuating those frequencies in the left signal channel that are outside of said selected predetermined bandwidth to produce a limited bandwidth left signal channel; correcting the phase angle of the limited bandwidth left signal channel; controlling the amplitude of the limited bandwidth left signal channel; inverting the limited bandwidth left signal channel; mixing the limited bandwidth, phase angle corrected, amplitude controlled, inverted left signal channel with the right signal channel to produce the modified right signal channel; outputting the modified right signal channel; and, producing the center channel by mixing the right and the left signal channels to form a combined signal; attenuating those frequencies in the combined signal channel that are below a selected predetermined center high pass cutoff frequency to produce the center signal channel; and outputting the center signal channel.

13. In an audio reproduction system whose inputs are a right and a left signal channel, the combination for decoding and dividing the right and left signal channel inputs into a modified right, a modified left and a center signal channels comprising: means for producing the modified left signal channel by attenuating those frequencies in the right signal channel that are outside of a selected predetermined bandwidth to produce a limited bandwidth right signal channel; operatively associated means for correcting the phase angle of the limited bandwidth right signal channel; operatively associated means for controlling the amplitude of the limited bandwidth right signal channel; operatively associated means for inverting the limited bandwidth right signal channel; operatively associated means for mixing the limited bandwidth, phase angle corrected, amplitude controlled, inverted, right signal channel with the left signal channel to produce the modified left signal channel; operatively associated means for outputting the modified left signal channel; and, operatively associated means for producing the modified right signal channel by attenuating those frequencies in the left signal channel that are outside of said selected predetermined bandwidth to produce a limited bandwidth left signal channel; operatively associated means for correcting the phase angle of the limited bandwidth left signal channel; operatively associated means for controlling the amplitude of the limited bandwidth left signal channel; operatively associated means for inverting the limited bandwidth left signal channel; operatively associated means for mixing the limited bandwidth, phase angle corrected, amplitude controlled, inverted, left signal channel with the right signal channel to produce the modified right signal channel; and, operatively associated means for producing the center channel by mixing the right and the left signal channels to form a combined signal; operatively associated means for attenuating those frequencies in the combined signal channel that are below a selected predetermined center high pass cutoff frequency to produce the center signal channel;

operatively associated means for outputting the center signal channel.

14. An apparatus for enhancing the perceived sound image of a stereophonic, audio reproduction system having a right and a left channel signal inputs and a modified right, a modified left and a center signal channel outputs comprising:

means for producing modified left and right signals where only audio information common to the right and left signal channel inputs is attenuated within a specified predetermined bandwidth within which most natural and artificial ambience occurs from each of said right and left channel inputs, said modified signal being passed to said modified right and said modified left channel outputs;

means for combining said right and said left signal channel inputs to produce a signal which is passed to a center channel output.

15. The apparatus in accordance with claim 14 further including:

means for attenuating said signal passed to said center channel output below a predetermined selected cutoff frequency.

* * * * *